United States Patent [19]

Ryan

[11] 4,091,716

[45] May 30, 1978

[54] FLUIDIC SERVO-SYSTEM AND METHOD

[75] Inventor: William Francis Ryan, Phoenix, Ariz.

[73] Assignee: The Garrett Corporation, Los Angeles, Calif.

[21] Appl. No.: 733,566

[22] Filed: Oct. 18, 1976

[51] Int. Cl.[2] ..... F15B 9/10; F15B 15/17

[52] U.S. Cl. ..... 91/49; 91/3; 91/376 R; 91/417 R; 137/810; 137/813; 91/388

[58] Field of Search ..... 91/3, 49, 417 R, 376 R, 91/388; 137/808, 809, 810, 811, 812, 813

[56] References Cited

U.S. PATENT DOCUMENTS

| | | | |
|---|---|---|---|
| 1,585,529 | 5/1926 | Boving | 91/49 |
| 2,405,382 | 8/1946 | Volet | 91/49 |
| 3,410,287 | 11/1968 | Heden et al. | 91/3 |
| 3,605,507 | 9/1971 | Ishihara et al. | 91/3 |
| 3,628,418 | 12/1971 | Honda | 91/417 R |
| 3,757,640 | 9/1973 | Karol | 91/49 |

*Primary Examiner*—Paul E. Maslousky

*Attorney, Agent, or Firm*—James W. McFarland; Albert J. Miller

[57] ABSTRACT

Pressurized motive fluid flow passes through a single fluidic vortex orifice to opposite chambers of a differential area, double acting, linear servo-cylinder. While shifting in one direction the vortex orifice severely restricts the flow to the fluid chamber of the motor which is contracting in size so as to permit rapid movement of the piston in that direction, and whenever the piston is moving in an opposite direction the vortex orifice allows substantially unrestricted fluid flow to the same chamber which is now expanding in size, so that the piston can shift rapidly in this opposite direction.

11 Claims, 3 Drawing Figures

FLUIDIC SERVO-SYSTEM AND METHOD

BACKGROUND OF THE INVENTION

This invention relates to fluid and servo follower systems, and relates more particularly to an improvement in such systems which allows rapid movement of the servo follower in opposite directions.

Servo systems of the type referred to generally include a fluid servo motor which is shiftable in opposite directions in response to corresponding movement of an input signal member. Exemplary devices of the class referred to are disclosed in the following U.S. Pat. Nos. 2,627,232; 2,655,133; 3,386,343; 3,628,418; 3,683,748. None of these patents disclose a structure in accordance with the operating principles and advantages associated with the present invention.

SUMMARY OF THE INVENTION

It is the primary object of the present invention to provide an improved servo-system and method of the type referred to which permits rapid movement of the servo follower in opposite directions.

Another important object of the present invention is to provide method and apparatus as set forth in the preceding object, wherein a fluidic device with no mechanical moving parts is utilized to substantially change the rate of fluid flow to one side of the double-acting servo motor depending upon the direction of movement of the output member of the motor, in order to provide the rapid motion in opposite directions.

Briefly stated, the present invention includes a fluid system that utilizes a double acting, differential area, linear cylinder motor having a piston within the interior cylinder dividing the latter into opposed fluid chambers. Actuating fluid is supplied to both chambers through a single fluidic vortex control orifice which has a signal port communicating with one chamber and an output port communicating with the other chamber. An exhaust opening from this latter chamber allows exhaust flow therefrom at a rate in relationship to an input signal member which is movable toward and away from the exhaust opening to variably restrict exhaust flow. Upon shifting away from the exhaust opening, the piston follows the input signal member at a relatively rapid rate, the vortex operating in such condition to greatly restrict input fluid flow to the chamber connected with the vortex orifices output port. Upon movement of the input signal member in an opposite direction toward the exhaust opening to greatly restrict exhaust flow therefrom, the piston shifts rapidly in the opposite direction since the vortex orifice operates automatically to, in effect, "remove" the restriction to input motive flow through its output port.

These and other more particular objects and advantages of the present invention are specifically set forth in or will become apparent from the following detailed description of a preferred embodiment of the invention, when read in conjunction with the accompanying drawing.

DETAILED DESCRIPTION OF THE PREFERRED EMBODIMENT

Figure 1:
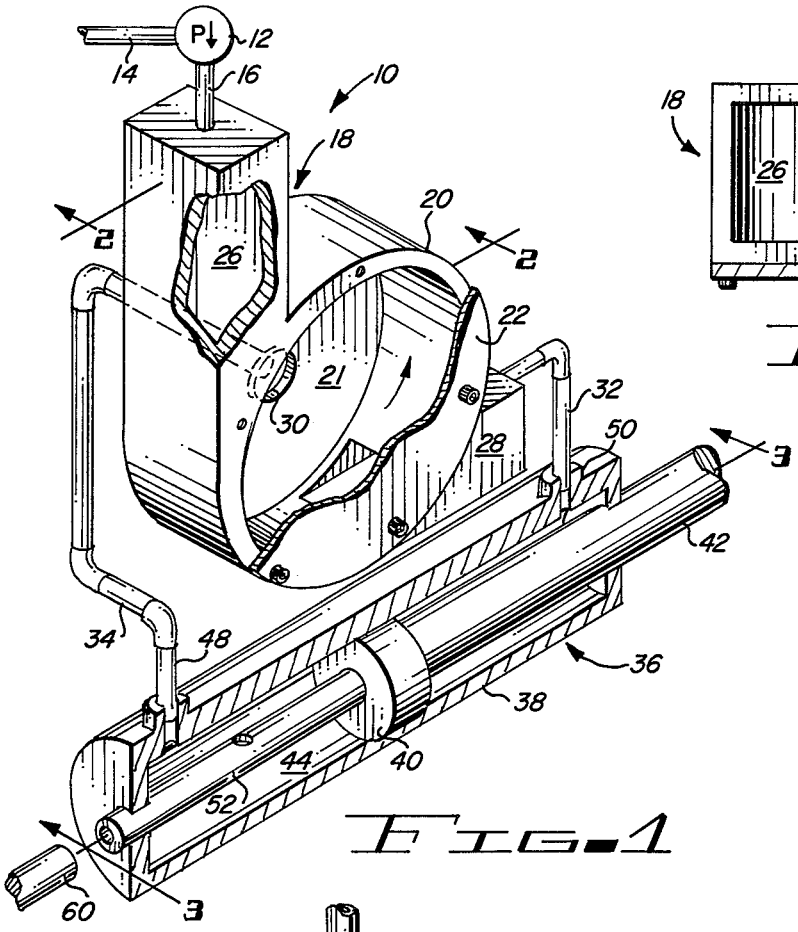
FIG. 1 is a partially cross-sectional, partially schematic, perspective view of apparatus constructed in accordance with the principles of the present invention, with portions broken away to reveal internal details of construction.
Figure 2:
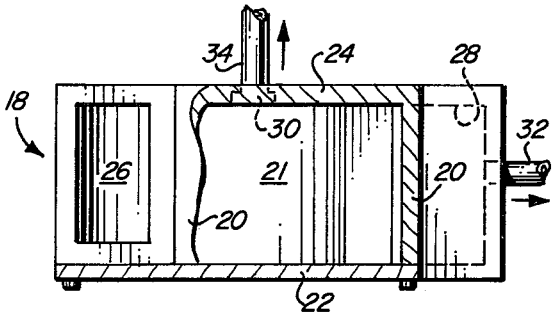
FIG. 2 is a partially cross-sectional, elevational view of the vortex orifice as viewed along lines 2—2 of FIG. 1.

Referring now more particularly to the drawing, a pneumatically operated, servo-actuator system of the type referred to is generally designated by the numeral 10 and includes a source of pressurized liquid or gas flow in the form of a pump 12 receiving intake flow through an input port 14 and delivering pressurized motive fluid flow through an output conduit 16. Output motive flow 16 passes through a fluidic vortex orifice generally designated by the numeral 18, and then through a pair of conduits 32 and 34 to opposite sides of a double-acting, pneumatically operated servo-motor generally designated by the numeral 36.

Vortex orifice 18 includes an upstanding, circular, peripheral wall 20 circumscribing an inner space 21 within the vortex orifice. Flat, parallel top and bottom walls 22 and 24 further define the extent of the inner space 21. Vortex orifice 18 further includes an input port 26 arranged at the peripheral wall 20 and communicating with conduit 16 such that motive fluid flow from pump 12 passes into space 21 tangentially to the circular peripheral wall 20 to flow in a vortex pattern. A single port 28 also communicates with the inner chamber 21 through peripheral wall 20 in a tangential arrangement to the peripheral wall to receive or oppose flow entering to or from tangential port 26 within the chamber 21. The vortex orifice 18 includes an output port 30 extending through bottom wall 24 to communicate with inner space 21 inwardly of the vortex action at the peripheral wall 20.

Pneumatic servo-motor 36 comprises a double-acting, differential area, linear piston-cylinder arrangement including a cylinder 38, and a piston 40 disposed within the interior of cylinder 38 and dividing the latter into first and second chambers 44 and 46 on opposite sides of piston 40. An output work rod 42 is operably connected to move with piston 40 and, as well known within the art, presents a differential area type of piston having a greater effective surface area on the face thereof exposed to pressure within chamber 44, than the area on the opposite side thereof exposed to pressure chamber 46. The cylinder 38 further includes first and second fluid ports 48 and 50 respectively communicating with chambers 44 and 46. Through signal conduit 32, the signal port 28 communicates with port 50 and chamber 46. Similarly, output conduit 44 interconnects output port 30 of the vortex orifice with the chamber 44 and associated fluid port 48.

An extension in the form of a vent tube 52 is rigidly interconnected to move with piston 40. Vent 52 has an internal blind bore 54 communicating with chamber 44 through a cross bore 56, and defines an exhaust opening 58 at the outer end of tube 52. The particular vent tube 52 illustrated is shown in a greatly magnified size for purposes of illustration, and also as shown in somewhat distorted form for purposes of illustration, it being noted that tube 52 is sized and configured in relation to cylinder 38 such that the exhaust opening 58 is always disposed exteriorially of cylinder 38 while piston 40 moves through its full stroke both rightwardly and leftwardly of the position illustrated. An input signal device, simply illustrated as a rod 60, is cooperable with the outer end of vent tube 52 in order to produce a variable restriction to exhaust flow through exhaust opening 58 to the surrounding external ambient pressure environment.

In use, pressurized motive fluid flow from pump 12 delivered into inner space 21 of the vortex orifice, swirls therearound tangentially to the peripheral wall 20. As is well known to those skilled in the art, the vortex action of the flow creates a relatively low pressure in the center of the inner space 21 so that, during normal operation, substantially greater pressure and flow rates are received through signal port 32 from inner space 21, than are received through output port 30. Though not necessary to an understanding of the present invention, a more detailed analysis and discussion of such fluid vortex orifices may be found in U.S. Pat. No. 3,207,168. In combination with the apparatus illustrated, however, the present invention utilizes such a fluid vortex orifice to provide peculiar advantages associated only with the present invention.

More particularly, the piston 40 and associated rod 42 of motor 36 act as a follower, output positioning member which shifts in response to like motion of input signal device 60. Upon shifting of input signal device 60 leftwardly away from opening 58 as viewed in FIGS. 1 and 3, a greater rate of flow is allowed to exhaust from chamber 44. Specifically, the size of the fluid restriction offered by the annular area defined between the input signal member 60 and exhaust opening 58 becomes greater than the effective orifice restriction created by vortex orifice 18. Accordingly, flow from chamber 44 may exhaust through opening 58 at a greater rate than the rate of input motive flow passing through output port 30 into chamber 44. Consequently, pressure in chamber 44 drops to a level substantially lower than the pressure developed in chamber 46, the latter of which approaches the pressure of motive fluid flow delivered by pump 12 by virtue of the positioning of signal port 28 at the peripheral wall 20 of the vortex orifice. Accordingly, piston 40 and the rod 42 shift rapidly leftwardly following the input signal device 60. During such movement, it will be apparent that the vortex created within inner space 21 of the vortex relatively severely restricts the rate of flow into chamber 44. This allows the rapid leftward movement of the piston 40, and also minimizes the rate of supply motive fluid flow from the pump 12 which passes directly out to the lower level ambient atmosphere. In this manner minimum flow losses are generated while assuring rapid leftward movement of the piston 40.

Figure 3:
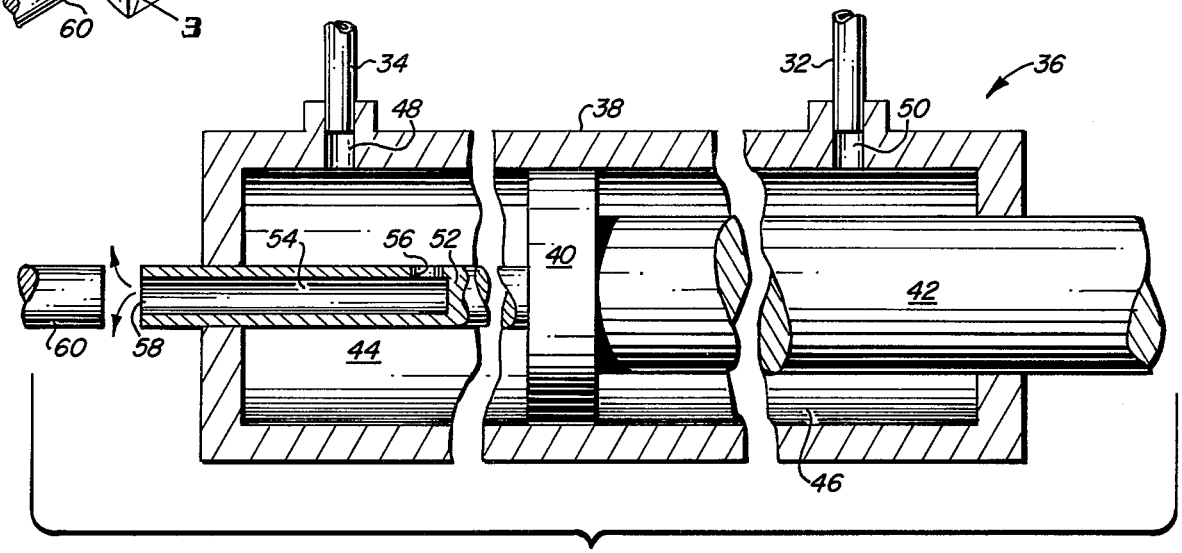
FIG. 3 is a cross-sectional view of the differential area motor and input signal device as generally viewed along lines 3—3 of FIG. 1.

Upon shifting input signal device 60 rightwardly as viewed in FIGS. 1 and 3, a substantial restriction to fluid flow through exhaust opening 58 is created. Accordingly, pressure in chamber 44 builds and, due to the differential areas of piston 40 respectively exposed to chambers 44 and 46, the piston 40 begins shifting rightwardly. Flow in chamber 46 now egresses through port 50, conduit 32 and signal port 28 toward the inner space 21. The net effect of this reverse flow is to substantially destroy the vortex flow pattern within inner space 21. Upon destruction of the vortex flow pattern, the vortex orifice 18 essentially permits unrestricted, pressurized flow through output port 30 into chamber 44. It is important to note in this context that the size of output port 30 is relatively large in relation to the orifice effect that previously occurred during leftward movement of piston 40. Accordingly pressure essentially at the pressure developed by pump 12 is delivered into chamber 44. More specifically, chambers 44 and 46 soon reach equal pressures, and due to the differential area, the piston 40 and rod 42 begin rapid movement rightwardly, following the input signal movement of device 60. Again, during this rightward movement of piston 40 there is a minimum standby flow loss of pressurized motive fluid flow since signal device 60 is closely adjacent exhaust opening 58 severely restricting exhaust flow therethrough.

It will be apparent to those skilled in the art, that through the automatic action of the vortex orifice 18 in respectively establishing and destroying the vortex flow pattern therewithin in relation to either ingress or egress of dluid flow from chamber 46 through its associated port 50, the piston and rod 42 move as a unit following the input signal device 60 at a rapid rate. Upon stoppage of movement of the input signal device 60, the piston and cylinder move until exhaust opening 58 is sufficiently near the input signal device 60 such that a condition of equilibrium is developed. Tests have shown that the system contemplated by the present invention provides extremely fast rate of movement of the output member 40 in both directions without creating a high steady state flow consumption.

From the foregoing it will be apparent that the present invention also contemplates an improved method of providing rapid movement of a follower servo-mechanism by generating first and second input signals for shifting the servo-mechanism in opposite directions; then fluidically, with the use of no moving mechanical part, relatively severely restricting motive fluid flow to one chamber of the motor in response to one of the signals and associated movement of the output member in one direction; and allowing substantially unrestricted flow of motive fluid to that one chamber in response to the other input signal and associated movement of the servo member in the opposite direction.

Various modifications and alterations to the specific embodiment described will be apparent to those skilled in the art. Accordingly, the foregoing detailed description of the preferred embodiment of the invention should be considered exemplary in nature and not as limiting to the scope and spirit of the invention as set forth in the appended claims.

Having described the invention with sufficient clarity that those skilled in the art may make and use it, I claim:

1. In combination:

a differential area fluid motor having a movable member mounted therein dividing the interior of the motor into first and second fluid chambers, said motor having separate fluid ports communicating with each of the chambers, said member having a greater effective surface area exposed to said first chamber than said second chamber;

a source of motive fluid conduit means communicating said source with both of said fluid ports; and fluidic means having no moving parts interposed in said conduit means whereby motive fluid flow passes through said fluidic means to both of said fluid ports, said fluidic means operable to permit flow of motive fluid at a relatively high flow rate from said source to said first chamber during movement of said member in a first direction, and for reducing the rate of fluid flow to said first chamber to a relatively low level during movement of said member in a second, opposite direction, said fluidic means being operably interconnected with said motor to produce said high and low flow rates to said first chamber respectively in response to egress and ingress of fluid flow through said port communicating with said second chamber.

2. A combination as set forth in claim 1, wherein said fluidic means includes a fluidic vortex orifice.

3. A combination as set forth in claim 2, wherein said fluidic vortex orifice has an inner space bounded by a generally circular peripheral wall, an input port communicating with said source and directing pressurized flow therefrom to enter and swirl in a vortex pattern in said inner space tangentially to said peripheral wall, said vortex orifice further including an output port communicating with said inner space at a location spaced inwardly of said peripheral wall and interconnected with said fluid port communicating with said first chamber, and said vortex orifice further including a signal port communicating with said inner space at said peripheral wall and interconnected with said fluid port communicating with said second chamber.

4. A combination as set forth in claim 3, wherein said fluid motor is a differential area, linear piston motor including a cylinder, said movable member comprising a piston traversing the interior of said cylinder.

5. A combination as set forth in claim 1, further including means for restricting exhaust gas flow from said first chamber.

6. A combination as set forth in claim 5, further including means defining an extension operably coupled and movable with said movable member, said extension defining an exhaust opening disposed exteriorly of said motor, said extension further including an internal passage communicating with said first chamber and said exhaust opening.

7. A combination as set forth in claim 6, wherein said variable restricting means comprises an input signal device movable toward and away from said exhaust opening to variably restrict exhaust flow thereto from said first chamber, whereby said movable member shifts relatively rapidly in both said first and second direction in response to corresponding movement of said input signal device.

8. In a servo-actuator system having a source of motive fluid, a differential area piston servo motor having a pair of ports communicating with said source and a separate exhaust opening effectively movable with the piston of said motor, and input signal means movable toward or away from said exhaust opening to variably restrict exhaust flow therethrough;

a fluidic vortex orifice disposed between said source and said pair of ports whereby motive fluid passes through said vortex orifice to both of said ports to drive the piston of said motor in opposite directions, said vortex orifice arranged and interconnected with said pair of ports to produce relatively low and high flow rates to one of said pair of ports respectively in response to ingress and egress of fluid flow to and from said motor through the other of said pair of ports.

9. A fluidic servo system, comprising:

a source of motive fluid;

a differential area fluid motor having a movable member mounted therein dividing the interior of said motor into first and second fluid chambers, said member having a greater effective surface area exposed to said first chamber than to said second chamber, said motor having a pair of fluid ports communicating with said chambers and an exhaust opening communicating with said first chamber;

input signal means shiftable toward and away from said exhaust opening to variably restrict exhaust flow from said first chamber; and a fluidic vortex orifice having an input port communicating with said source, an output port communicating with said fluid port of said first chamber, and a signal port communicating with said fluid port associated with the second chamber, whereby motive fluid flow from said source passes through said vortex orifice to both of said first and second chambers to actuate said member in opposite directions.

10. In a fluidic servo-actuator system:

a source of pressurized fluid flow;

a cylinder having a pair of fluid ports;

a conduit interconnecting said source and both of said fluid ports;

differential area piston means movably mounted in said cylinder and dividing the interior thereof into first and second chambers associated with said pair of fluid ports, said piston means having a greater effective area exposed to pressure of fluid in said first chamber than said second chamber;

an extension secured to said piston means and extending through said cylinder, said extension defining an exhaust opening and having a duct in communication with said first chamber and said exhaust opening;

an input signal member shiftable toward and away from said exhaust opening to respectively increase and decrease restriction to exhaust fluid flow from said first chamber through said exhaust opening; and a fluidic vortex orifice having no mechanical moving parts interposed in said conduit, said vortex orifice having an inner space bounded by a generally circular peripheral wall and having an input port communicating with said source and directing pressurized fluid flow therefrom to enter and swirl in a vortex pattern in said inner space tangentially to said peripheral wall, said vortex orifice further including an output port communicating with said inner space at a located spaced inwardly of said peripheral wall and interconnected with said fluid port associated with said first chamber, said vortex orifice further including a signal port communicating with said internal chamber at said peripheral wall and interconnected with said fluid port associated with said second chamber;

whereby upon movement of said member away from said extension, said vortex orifice fluidically restricts flow through said output port to a relatively low flow rate to produce a substantially greater pressure in said first chamber than said second chamber and consequent relatively rapid movement of said piston means in one direction, and upon movement of said member toward said extension, said vortex orifice permits substantially unrestricted flow through said output port to maintain substantially equal pressure in said first and second chambers and consequent relatively rapid movement of said piston means in a second, opposite direction.

11. A method of providing rapid movement in opposite directions of a differential area servo piston mounted within a cylinder and dividing the interior thereof into first and second chambers both communicating with a common source of motive fluid flow, comprising the steps of:

directing fluid flow from the source to an inlet port of a fluidic vortex orifice whose output port communicates with said first chamber;

producing a first signal relatively severely restricting exhaust of flow from said first chamber to drive said piston in one direction;

producing a second signal permitting relatively unrestricted exhaust flow from said first chamber to drive said piston in an opposite direction;

directing exhaust flow from said second chamber to a signal port of said vortex orifice in response to said second signal to substantially eliminate the orificing action of said vortex orifice and thus allow substantially unrestricted flow of pressurized motive fluid from the source to both of said first and second chambers, to produce substantially equal pressures in said chambers and drive said piston rapidly in said one direction with relatively low exhaust flow from said cylinder; and said vortex orifice automatically fluidically relatively severely restricting flow of pressurized motive fluid from the source to said first chamber without restricting motive fluid flow to said second chamber in response to said second signal, to produce substantially greater pressure in said first chamber than said second chamber and drive said piston rapidly in said opposite direction with relatively low exhaust flow from said cylinder.

* * * * *